United States Patent [19]

Yunoki et al.

[11] 4,314,519

[45] Feb. 9, 1982

[54] BALLAST PUMPING SYSTEM

[75] Inventors: Shigeto Yunoki, Tokyo; Masataka Makizono, Sakado, both of Japan

[73] Assignee: Yamashita-Shinnihon Steamship Co., Ltd., Tokyo, Japan

[21] Appl. No.: 124,942

[22] Filed: Feb. 26, 1980

[30] Foreign Application Priority Data

Mar. 14, 1979 [JP] Japan ..... 54-029289

[51] Int. Cl.[3] ..... B63B 39/03

[52] U.S. Cl. ..... 114/125; 114/184

[58] Field of Search ..... 114/74 R, 74 A, 125, 114/184, 333

[56] References Cited

U.S. PATENT DOCUMENTS

| | | | |
|---|---|---|---|
| 2,404,202 | 7/1946 | Winslow | 114/184 X |
| 3,209,715 | 10/1965 | Campbell et al. | 114/74 R |
| 4,228,788 | 10/1980 | Moeser | 114/125 |

*Primary Examiner*—William A. Cuchlinski, Jr.

*Attorney, Agent, or Firm*—Koda and Androlia

[57] ABSTRACT

A ballast pumping system for pumping water ballast to or from a plurality of ship ballast tanks, having a submerged pump located in one of the ballast tanks and a sea chest provided in the ballast tank together with the pump. Piping interconnects the pump and the sea chest, and also connects the pump to each of the bottoms of the ballast tanks.

3 Claims, 6 Drawing Figures

FIG. 1
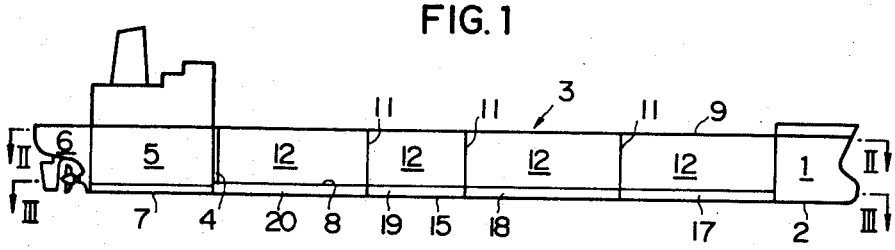
FIG. 2
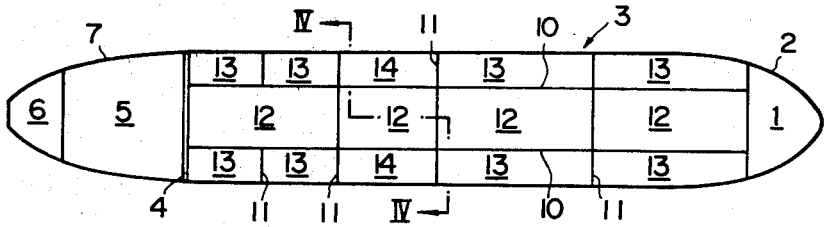
FIG, 3
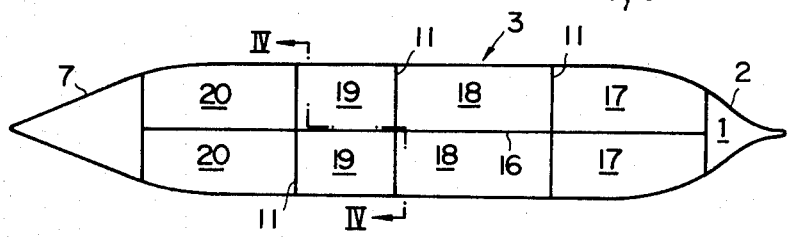

BALLAST PUMPING SYSTEM

BACKGROUND OF THE INVENTION

This invention relates to an improved ballast pumping system and, more specifically, relates to a tanker's ballast pumping system having submerged pumps in ballast tanks.

In existing tankers, ballast pumps are usually located in a machinery room together with a main engine or in a pump room along with cargo pumps. This arrangement, however, will require additional space in the machinery room or pump room, resulting in a decrease in the cargo space. In addition, longer distance between the ballast pumps and ballast tanks will reduces the pumping performance.

SUMMARY OF THE INVENTION

According to this invention there is provided a ballast pumping system having a submerged pump located in one of ballast tanks and a sea chest, whose inside communicates with the outside of the ship, provided in the hull bottom near the pumps. Piping interconnects the pump and the sea chest, and also connects the pump to each of the bottoms of the ballast tanks so that the pump may ballast and deballast the tanks. The installation of the ballast pump in the ballast tank reduces the space of the machinery room or pump room, thus increasing cargo space. This arrangement also lessens the number of the submerged pumps because each of the ballast tanks does not require its own pump. The distance between the pump and the cargo tanks is shorter than that of the existing system, therefore good pumping performance will be provided.

Preferably, the piping interconnecting the pump and each ballast tank includes a main pipe connecting with the pump and a branch pipes interconnecting the main pipe and each of the bottoms of the ballast tanks. This arrangement simplifies the piping. Use of a reversible type of pump reduces the number of the valves in the system and simplifies the ballast operation.

The sea chest preferably communicates with the ballast tanks having the sea chest directly through a outboard valve, which provides an additional pumping ability to the ballast pumping system.

BRIEF DESCRIPTION OF THE DRAWINGS

While the invention is particularly pointed out and distinctly claimed in a concluding portion of the specification, a preferred embodiment is set forth in the following detailed description which may be best understood when read in connection with the following drawings, in which:

FIG. 1 is a longitudinal sectional view of a tanker;

FIG. 2 is a sectional view taken on line II—II in FIG. 1;

FIG. 3 is a sectional view taken on line III—III in FIG. 1;

DETAILED DESCRIPTION OF THE INVENTION

Figure 4:
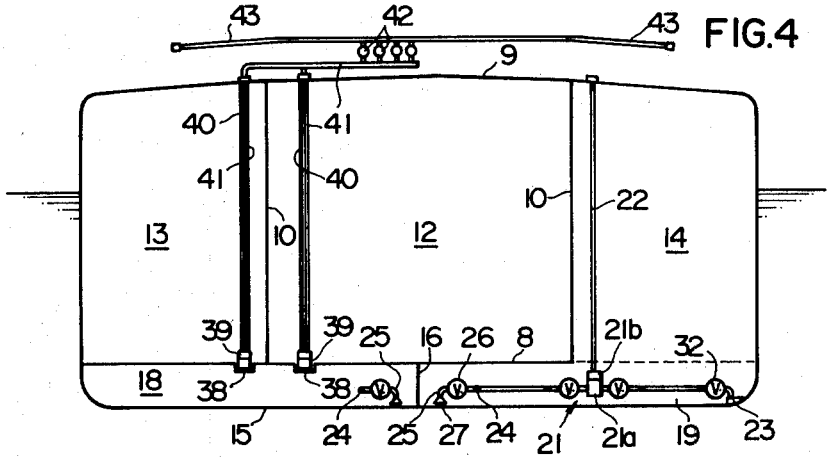
FIG. 4 is a midship sectional view taken on bent line IV—IV in FIGS. 2 and 3.

Referring now to the drawings, there is shown a tanker of 50,000 tons deadweight, which has a bow part 2, a stern part 7, and a midship tank part 3 between them. The bow part 2 includes a forepeak water ballast tank 1, and the stern part 7 also includes a machinery space 5, afterpeak water ballast tank 6, and a cofferdam 4.

An inner bottom 8 with the full breadth of the ship extends over the length of the midship tank part 3 and machinery space 5. Two rows of longitudinal bulkheads 10 also extend over the length of the midship tank part 3. Transverse bulkheads 11 are provided between the side shell plates. The longitudinal and transverse bulkheads 10, 11 divide the space within the midship tank part 3 into center cargo tanks 12, wing cargo tanks 13, and segregated deep ballast tanks 14. Transverse bulkheads 11, together with a center girder 16 extending longitudinally along the keel, divide the double bottom space into segregated ballast tanks 17, 18, 19, 20. The third double bottom tanks 19 are actually joined to the deep ballast tanks 14 by perforating the inner bottom 8 in part as shown in FIG. 4.

In each of the double bottom ballast tanks 19 is installed a submerged ballast pump 21 which consists of a pump section 21*a* and hydraulic motor section 21*b* thereon as shown in FIG. 4. The motor 21*b* is supplied with oil from a hydraulic oil source (not shown) on the upper deck 9 through pipes 22.

In the double bottom ballast tanks 19 is also located a sea chest 23 the inside of which communicates with the outside of the hull.

Figure 5:
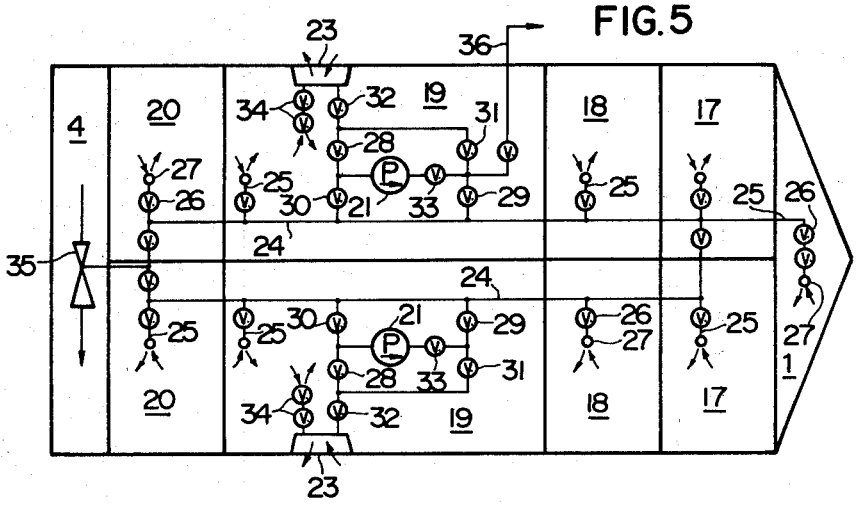
FIG. 5 is a schematic diagram of a ballast pumping system.

A schematic diagram of a ballast pumping system is shown in FIG. 5. A main ballast pipe 24 runs longitudinally within the double bottom tanks 17, 18, 19, 20, and branch pipes 25 leading from the main pipe 24 extend to each of the bottoms of the double bottom ballast tanks 17, 18, 19, 20 and the forepeak tank 1. Each of the branch pipes have a valve 26 and a suction bell-mouth 27. Valves 28 and 31 connect the sea chest 23 to the suction or delivery side of the pump 21 selectively; valves 29 and 30 also connect the main pipe 24 to the suction or delivery side of the pump 21.

In ballasting, the pump 21 draws sea water from the sea chest through valve 32 and 28, and send the water past valves 33, 29, through the main pipe 24 and the branch pipes 25, into each of the ballast tank 1, 17, 18, 19, 20. In deballasting, the pump 21 draws ballast water from each of the ballast tanks through branch and main pipe 25, 24 past the valve 30, and in turn delivers the ballast outboard via valves 33, 31, 34 through the sea chest 23.

The tank 19 communicates with the sea chest 23 directly through outboard valves 34, which permit passage of sea water to or from the tank 19 when there is a difference between the tank water level and outboard water level. These valves 34 are used for ballasting or deballasting the tank 19.

A water-driven ejector 35 is located in the cofferdam 4, and its suction is connected to the main pipes 24. The ejector is used in the event of failure of the pump 21 for deballasting of the ballast tanks.

A pipe 36 branchs off from the delivery side of the pump 21 and leads to the second center cargo tank 12. This pipe provides additional water ballast into the cargo tank for the safety of ship in extremely severe weather conditions.

In the cargo tanks 12, 13 are formed suction wells 38, in which submarged cargo pumps 39 are mounted as shown in FIG. 4. The pump 39 incorporates a hydraulic motor, for which oil is supplied through pipes 40 from a hydraulic oil source (not shown) on the upper deck 9. Cargo oil branch pipes 41 extend from the discharge sides of the cargo oil pumps 39 to cargo oil main pipes 42 which run longitudinally on upper deck 9. The cargo oil main pipes 42 are joined with shore connections 43 at the midship.

In cargo loading, cargo sent from shore pumps (not shown) flows through the shore connections 43 and cargo oil main and branch pipes 42, 41, past the cargo oil pumps 39, into each of cargo tanks 12, 13. Also in unloading, the cargo pumped from each of the cargo tanks 12, 13 by the cargo pumps 39 flows through the cargo branch and main pipes 41, 42 past shore connections 43 to shore tanks (not shown).

Figure 6:
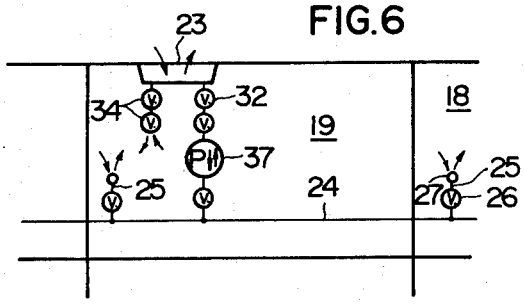
FIG. 6 is a partial diagram of a modified ballast pumping system.

FIG. 6 shows a modified ballast pumping system, which includes submerged pumps 37 of the reversible type permitting the flow direction to be changed. Use of this type of pump simplifies the piping and operation of the system.

Although what has been described herein is a preferred embodiment of the invention, it is, of course, to be understood that various modifications and changes may be made therein without departing from the invention. It is, therefore, intended to cover in the following claims all such modifications and changes as may fall within the true sprit and scope of the invention.

We claim:

1. A ballast pumping system for pumping water ballast from or to the sea respectively to or from a plurality of ballast tanks provided within the hull of a ship, comprising:

a hydraullically operated submerged ballast pump located in one of said ballast tanks;

a sea chest provided in the bottom of the hull of said ship adjacent said ballast pump, said sea chest having an interior region in fluid communication with the sea;

outboard valve means for selectively directly connecting said sea chest and the ballast tank in which said sea chest is located;

first piping means for interconnecting said pump and said sea chest;

second piping means for interconnecting said pump and the respective bottom regions of each of said ballast tanks, said second piping means comprising a main pipe and a plurality of branch pipes, said main pipe being directly connected to said pump and each of said branch pipes interconnecting said main pipe with a respective one of said ballast tanks.

2. A ballast pumping system according to claim 1, wherein said submerged pump is of the reversible type which allows the flow direction to be changed.

3. A ballast pumping system according to claim 2, comprising a water-driven ejector for backing up said pump, the suction of which is connected to said main pipe.

* * * * *